US010920297B2

(12) United States Patent
Yuga et al.

(10) Patent No.: US 10,920,297 B2
(45) **Date of Patent: *Feb. 16, 2021**

(54) HIGH-STRENGTH SEAMLESS STEEL PIPE FOR OIL COUNTRY TUBULAR GOODS AND METHOD OF PRODUCING THE SAME

(71) Applicant: JFE STEEL CORPORATION, Tokyo (JP)

(72) Inventors: Masao Yuga, Handa (JP); Yasuhide Ishiguro, Handa (JP); Mitsuhiro Okatsu, Handa (JP); Seiji Nabeshima, Kurashiki (JP); Hiroki Ota, Handa (JP)

(73) Assignee: JFE STEEL CORPORATION, Tokyo (JP)

( * ) Notice: Subject to any disclaimer, the term of this patent is extended or adjusted under 35 U.S.C. 154(b) by 139 days.

This patent is subject to a terminal disclaimer.

(21) Appl. No.: 15/527,893

(22) PCT Filed: Aug. 20, 2015

(86) PCT No.: PCT/JP2015/004182
§ 371 (c)(1),
(2) Date: May 18, 2017

(87) PCT Pub. No.: WO2016/079908
PCT Pub. Date: May 26, 2016

(65) Prior Publication Data

US 2018/0327881 A1 Nov. 15, 2018

(30) Foreign Application Priority Data

Nov. 18, 2014 (JP) ..... JP2014-233682

(51) Int. Cl.

| | |
|---|---|
| ***C22C 38/02*** | (2006.01) |
| ***C21D 1/18*** | (2006.01) |
| ***C21D 8/10*** | (2006.01) |
| ***C21D 9/08*** | (2006.01) |
| ***C21D 9/46*** | (2006.01) |
| ***C22C 38/00*** | (2006.01) |
| ***C22C 38/04*** | (2006.01) |
| ***C22C 38/06*** | (2006.01) |
| ***C22C 38/14*** | (2006.01) |
| ***C22C 38/18*** | (2006.01) |
| ***C22C 38/22*** | (2006.01) |
| ***C22C 38/24*** | (2006.01) |
| ***C22C 38/26*** | (2006.01) |
| ***C22C 38/32*** | (2006.01) |
| ***C22C 38/42*** | (2006.01) |
| ***C22C 38/44*** | (2006.01) |

(Continued)

(52) U.S. Cl.

CPC ..... *C21D 9/085* (2013.01); *C21D 1/18* (2013.01); *C21D 6/02* (2013.01); *C21D 8/10* (2013.01); *C21D 8/105* (2013.01); *C21D 9/08* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/18* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/40* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 2211/001* (2013.01); *C21D 2211/004* (2013.01); *C21D 2211/008* (2013.01)

(58) Field of Classification Search

USPC ..... 148/320, 333, 334

See application file for complete search history.

(56) References Cited

U.S. PATENT DOCUMENTS 4,075,041 A * 2/1978 Ueno ..... B21B 17/14 148/593
9,708,681 B2 7/2017 Eguchi et al.
(Continued)

FOREIGN PATENT DOCUMENTS

EP 1 911 857 A1 4/2008
EP 2 361 996 A2 8/2011
(Continued)

OTHER PUBLICATIONS

Nov. 17, 2015 International Search Report issued in International Application No. PCT/JP2015/004182.
Feb. 25, 2019 Office Action issued in U.S. Appl. No. 15/509,361.
Apr. 16, 2019 Office Action issued in U.S. Appl. No. 15/509,350.
Sep. 18, 2017 Extended European Search Report issued in European Patent Application No. 15860191.4.
Oct. 30, 2019 Office Action issued in U.S. Appl. No. 15/537,703.
Oct. 30, 2019 Office Action issued in U.S. Appl. No. 15/537,669.
Sep. 5, 2019 Office Action issued in U.S. Appl. No. 15/509,350.
Jun. 10, 2020 Office Action issued in U.S. Appl. No. 16/064,086.
(Continued)

*Primary Examiner* — Brian D Walck
(74) *Attorney, Agent, or Firm* — Oliff PLC

(57) ABSTRACT

A seamless steel pipe having a specific chemical composition. A ratio of Ti to N is in a range of 2.0 to 5.0. The steel pipe has a microstructure including tempered martensite having a volume ratio of 95% or more, and prior austenite grains having a grain size number of 8.5 or more. In a cross-section perpendicular to a rolling direction of the steel pipe a number of nitride-based inclusions having a particle size of 4 μm or more is 100 or less per 100 $mm^2$, a number of nitride-based inclusions having a particle size of less than 4 μm is 1000 or less per 100 $mm^2$, a number of oxide-based inclusions having a particle size of 4 μm or more is 40 or less per 100 $mm^2$, and a number of oxide-based inclusions having a particle size of less than 4 μm is 400 or less per 100 $mm^2$.

16 Claims, No Drawings

(51) Int. Cl.

| | |
|---|---|
| ***C22C 38/46*** | (2006.01) |
| ***C22C 38/48*** | (2006.01) |
| ***C22C 38/50*** | (2006.01) |
| ***C22C 38/54*** | (2006.01) |
| ***C21D 6/02*** | (2006.01) |
| ***C22C 38/20*** | (2006.01) |
| ***C22C 38/28*** | (2006.01) |
| ***C22C 38/08*** | (2006.01) |
| ***C22C 38/40*** | (2006.01) |

(56) References Cited

U.S. PATENT DOCUMENTS

| | | | |
|---|---|---|---|
| 2004/0238075 | A1 | 12/2004 | Kondo |
| 2006/0016520 | A1 | 1/2006 | Numata et al. |
| 2008/0219878 | A1 | 9/2008 | Kondo et al. |
| 2009/0098403 | A1 | 4/2009 | Omura et al. |
| 2012/0186704 | A1 | 7/2012 | Eguchi et al. |
| 2014/0352836 | A1 | 12/2014 | Eguchi et al. |
| 2015/0041030 | A1 | 2/2015 | Kondo et al. |
| 2015/0114527 | A1 | 4/2015 | Omura et al. |
| 2017/0275715 | A1 | 9/2017 | Yuga et al. |
| 2017/0349963 | A1 | 12/2017 | Yuga et al. |
| 2017/0349964 | A1 | 12/2017 | Yuga et al. |
| 2018/0327881 | A1 | 11/2018 | Yuga et al. |
| 2019/0024201 | A1 | 1/2019 | Yuga et al. |

FOREIGN PATENT DOCUMENTS

| | | | |
|---|---|---|---|
| EP | 2 403 970 | B1 | 5/2013 |
| EP | 2 796 587 | A1 | 10/2014 |
| EP | 2 824 198 | A1 | 1/2015 |
| JP | 2000-178682 | A | 6/2000 |
| JP | 2000-297344 | A | 10/2000 |
| JP | 2001-172739 | A | 6/2001 |
| JP | 2007-16291 | A | 1/2007 |
| JP | 2014-012890 | A | 1/2014 |
| WO | 2006-009142 | A1 | 1/2006 |
| WO | 2010/150915 | A1 | 12/2010 |
| WO | 2013/094179 | A1 | 6/2013 |
| WO | 2013/133076 | A1 | 9/2013 |
| WO | 2013-191131 | A1 | 12/2013 |

OTHER PUBLICATIONS

Apr. 30, 2020 Office Action issued in U.S. Appl. No. 15/537,669.
Apr. 30, 2020 Office Action issued in U.S. Appl. No. 15/537,703.
Jul. 10, 2020 Office Action issued in U.S. Appl. No. 16/078,919.
Jul. 24, 2020 Office Action issued in U.S. Appl. No. 16/078,924.

* cited by examiner

HIGH-STRENGTH SEAMLESS STEEL PIPE FOR OIL COUNTRY TUBULAR GOODS AND METHOD OF PRODUCING THE SAME

TECHNICAL FIELD

This application relates to a high-strength seamless steel pipe suitable for oil country tubular goods or line pipes and particularly relates to an improvement in sulfide stress corrosion cracking resistance[A1] (hereinafter referred to as "SSC resistance") in a wet hydrogen sulfide environment (sour environment).

BACKGROUND

In recent years, from the view point of stable securement of energy resources, oil wells and natural gas wells at a deep depth in a severe corrosive environment have been developed. Therefore, for oil country tubular goods for drilling and line pipes for transport, SSC resistance in a sour environment containing hydrogen sulfide ($H_2S$) is strongly required to be superior while maintaining a high yield strength YS of 125 ksi or higher.

In order to satisfy the requirements, for example, PTL 1 discloses a method of producing steel for oil country tubular goods, the method including: preparing low alloy steel containing C, Cr, Mo, and V such that the contents thereof are adjusted to be, by weight %, C: 0.2% to 0.35%, Cr: 0.2% to 0.7%, Mo: 0.1% to 0.5%, and V: 0.1% to 0.3%; quenching the low alloy steel at an $Ac_3$ transformation point or higher; and tempering the low alloy steel in a temperature range of 650° C. to an $Ac_1$ transformation point. According to the description of the technique disclosed in PTL 1, the low alloy steel can be adjusted such that a total amount of precipitated carbides is 2 wt % to 5 wt %, and a ratio of an MC carbide to the total amount of the precipitated carbides is 8 wt % to 40 wt %, and therefore, steel for oil country tubular goods having superior sulfide stress corrosion cracking resistance can be obtained.

In addition, PTL 2 discloses a method of producing steel for oil country tubular goods having superior toughness and sulfide stress corrosion cracking resistance, the method including: preparing low alloy steel containing, by mass %, C: 0.15% to 0.3%, Cr: 0.2% to 1.5%, Mo: 0.1% to 1%, V: 0.05% to 0.3%, and Nb: 0.003% to 0.1%; heating the low alloy steel to 1150° C. or higher; finishing hot working at 1000° C. or higher; and performing a quenching-tempering treatment on the low alloy steel at least once in which the low alloy steel is quenched from a temperature of 900° C. or higher, is tempered in a range of 550° C. to an $Ac_1$ transformation point, quenched after reheating it in a range of 850° C. to 1000° C., and is tempered in a range of 650° C. to the $Ac_1$ transformation point. According to the technique disclosed in PTL 2, the low alloy steel can be adjusted such that a total amount of precipitated carbides is 1.5 mass % to 4 mass %, a ratio of an MC carbide to the total amount of the precipitated carbides is 5 mass % to 45 mass %, and a ratio of an $M_{23}C_6$ carbide to the total amount of the precipitated carbides is 200/t (t: thickness (mm)) percent by mass or less, and therefore, steel for oil country tubular goods having superior toughness and sulfide stress corrosion cracking resistance can be obtained.

In addition, PTL 3 discloses steel for oil country tubular goods containing, by mass %, C: 0.15% to 0.30%, Si: 0.05% to 1.0%, Mn: 0.10% to 1.0%, Cr: 0.1% to 1.5%, Mo: 0.1% to 1.0%, Al: 003% to 0.081 N: 0.008% or less, B: 0.0005% to 0.010%, and Ca+O: 0.008% or less and further containing one element or two or more elements of Ti: 0.005% to 0.05%, Nb: 0.05% or less, Zr: 0.05% or less, and 0.30% or less, in which a maximum length of non-metallic inclusions in a row in cross-section observation is 80 μm or shorter, and the number of non-metallic inclusions having a particle size of 20 m or more in the cross-section observation is 10 inclusions/100 $mm^2$ or less, and thus, low alloy steel for oil country tubular goods which has high strength required for oil country tubular goods and has superior SSC resistance corresponding to the strength can be obtained.

In addition, PTL 4 discloses low alloy steel for oil country tubular goods having superior sulfide stress corrosion cracking resistance, the steel containing, by mass %, C: 0.20% to 0.35%, Si: 0.05% to 0.5%, Mn: 0.05% to 0.6%, P: 0.025% or less, S: 0.01% or less, Al: 0.005% to 0.100%, Mo: 0.8% to 3.0%, V: 0.05% to 0.25%, B: 0.0001% to 0.005%, N: 0.01% or less, and O: 0.01% or less, in which $12V+1-Mo \geq 2-10$ is satisfied. According to the technique disclosed in PTL 4, in addition to the above-described composition, the steel may further contain Cr: 0.6% or less such that Mo—(Cr+Mn)≥0 is satisfied, may further contain one or more elements of Nb: 0.1% or less, Ti: 0.1% or less, and Zr: 0.1% or less, or may further contain Ca: 0.01% or less.

CITATION LIST

Patent Literature

[PTL 1] JP-A-2000-178682
[PTL 2] JP-A-2000-297344
[PTL 3] JP-A-2001-172739
[PTL 4] JP-A-2007-1691

SUMMARY

Technical Problem

However, there are various factors affecting sulfide stress corrosion cracking resistance (SSC resistance) Therefore, it cannot be said that the application of only the techniques disclosed in PTLs 1 to 4 is sufficient for improving SSC resistance of a high-strength seamless steel pipe having a yield strength (YS) of 125 ksi or higher to a degree that is sufficient for oil country tubular goods in a severe corrosive environment. Moreover, there are problems in that it is significantly difficult to stably adjust the kinds and amounts of the carbides disclosed in PTLS 1 and 2 and the shapes and numbers of the non-metallic inclusions disclosed in PTL 3 to be within the desired ranges.

The disclosed embodiments have been made in order to solve the problems of the related art, and an object thereof is to provide a high-strength seamless steel pipe for oil country tubular goods having superior sulfide stress corrosion cracking resistance; and a method of producing the same.

"High strength" described herein refers to a yield strength (YS) being 125 ksi (862 MPa) or higher. In addition, "superior sulfide stress corrosion cracking resistance" described herein refers to a case where no cracking occurs with an applied stress of 85% of the yield strength of a specimen for over 720 hours when a constant-load test is performed in an acetic acid-sodium acetate solution (liquid temperature: 24° C.) saturated with hydrogen sulfide at 10 kPa, having an adjusted pH of 3.5, and containing 5.0 mass % of sodium chloride solution according to a test method defined in NACE TMO177 Method A.

Solution to Problem

In order to achieve the above-described objects, it is necessary to simultaneously realize desired high strength and superior SSC resistance. Therefore, the present inventors thoroughly investigated various factors affecting strength and SSC resistance. As a result, it was found that, in a high-strength steel pipe having a yield strength YS of 125 ksi class or higher, nitride-based inclusions and oxide-based inclusion have a significant effect on SSC resistance although the effect varies depending on the sizes thereof. It was found that any of nitride-based inclusion having a particle size of 4 μm or more and oxide-based inclusions having a particle size of 4 μm or more cause sulfide stress corrosion cracking (SSC) and SSC is likely to occur as the sizes thereof increase. It was found that the presence of a single nitride-based inclusion having a particle size of less than 4 μm does not cause SSC; however, the nitride-based including having a particle size of less than 4 μm adversely affect SSC resistance when the number thereof is large. In addition, it was also found that oxide-based inclusion having a particle size of less than 4 μm adversely affect SSC resistance when the number thereof is large.

Therefore, the present inventors thought that, in order to further improve SSC resistance, it is necessary to adjust the numbers of nitride-based inclusions and oxide-based inclusions to be appropriate numbers or less depending on the sizes thereof. In order to adjust the numbers of nitride-based inclusions and oxide-based inclusions to be appropriate numbers or less, it is important to control the N content and the O content to be in desired ranges during the preparation of a steel pipe raw material, particularly, during the melting and casting of molten steel. Moreover it is important to control manufacturing conditions in a refining process and continuous casting process of molten steel.

The present inventors performed additional investigation based on the above findings and completed the disclosed embodiments. That is, the summary of the disclosed embodiments is as follows.

(1) A high-strength seamless steel pipe for oil country tubular goods having a yield strength (YS) of 862 MPa or higher, the steel pipe having a composition including, by mass %, C: 0.20% to 0.50%,
Si: 0.05% to 0.40%,
Mn: 0.3% to 0.9%,
P: 0.015% or less,
S: 0.005% or less,
Al: 0.005% to 0.1%,
N: 0.006% or less,
Cr: more than 6% and 1.7% or less,
Mo: more than 1.0% and 3.0% or less,
V: 0.02% to 0.3%,
Nb: 0.001% to 0.02%,
B: 0.0003% to 0.0030%,
O (oxygen): 0.0030% or less,
Ti: 0.003% to 0.025%, and a remainder including Fe and unavoidable impurities, in which contents of Ti and N are adjusted to satisfy Ti/N: 2.0 to 5.0, the steel pipe having a microstructure in which tempered martensite has a volume ratio of 95% or more, prior austenite grains have a grain size number of 9.5 or more, and in a cross-section perpendicular to a rolling direction, the number of nitride-based inclusions having a particle size of 4 μm or more is 100 or less per 100 $mm^2$, the number of nitride-based inclusions having a particle size of less than 4 μm is 1000 or less per 100 $mm^2$, the number of oxide-based inclusions having a particle size of 4 μm or more is 40 or less per 100 $mm^2$, and the number of oxide-based inclusions having a particle size of less than 4 μm is 400 or less per 100 $mm^2$.

(2) The high-strength seamless steel pipe for oil country tubular goods according to (1), the steel pipe having the composition further including, one element or two or more elements selected from, by mass %, Cu: 1.0% or less,
Ni: 1.0% or less, and
W: 3.0% or less, (3) The high-strength seamless steel pipe for oil country tubular goods according to (1) or (2), the steel pipe having the composition further including, by mass %, Ca: 0.0005% to 0.0050%.

(4) A method of producing a seamless steel pipe for oil country tubular goods, performing heating on a steel pipe raw material, performing hot working on the heated steel pipe raw material to form a seamless steel pipe having a predetermined shape, the seamless steel pipe being the high-strength seamless steel pipe for oil country tubular goods according to any one of (1) to (3), the method including:

a heating temperature in the heating of the steel pipe raw material being set within a range of 1050° C. to 1350° C.;

performing cooling on the seamless steel pipe at a cooling rate equal to or higher than that of air cooling after the hot working until a surface temperature of the seamless steel pipe reaches 200° C. or lower;

performing a quenching treatment on the seamless steel pipe at least once after the cooling in which the seamless steel pipe is reheated to a temperature in a range of an $Ac_3$ transformation point to 1000° C. or lower and is rapidly cooled until the surface temperature of the seamless steel pipe reaches 200° C. or lower; and performing a tempering treatment after the quenching treatment in which the seamless steel pipe is heated to a temperature in a range of 600° C. to 740° C.

Advantageous Effects

According to the disclosed embodiments, a high-strength seamless steel pipe for oil country tubular goods having a high yield strength YS of 125 ksi (862 MPa) or higher and superior sulfide stress corrosion cracking resistance can be easily produced at a low cost, and industrially significant advantages are exhibited. According to the disclosed embodiments, appropriate alloy elements are contained in appropriate amounts, and the formation of nitride-based inclusions and oxide-based inclusions is suppressed. As a result, a high-strength seamless steel pipe having a desired high strength for oil country tubular goods and superior SSC resistance can be stably produced.

DETAILED DESCRIPTION

First, the reason for limiting the composition of a high-strength seamless steel pipe according to the disclosed embodiments will be described. Hereinafter, "mass %" in the composition will be referred to simply as "%".

C. 0.20% to 0.50%

C contributes to an increase in the strength of steel by solid-solution and also contributes to the formation of a microstructure containing martensite as a main phase during quenching improving the hardenability of steel. In order to obtain the above-described effects, the C content is necessarily 0.20% or more. On the other hand, when the C content is more than 0.50%, cracking occurs during quenching, and the producibility significantly decreases. Therefore, the C content is limited to a range of 0.20% to 0.50%. Preferably, the C content is 0.20% to 0.35%. More preferably, the C content is 0.22% to 0.32%.

Si: 0.05% to 0.40%

Si is an element which functions as a deoxidizer and has an effect of increasing the strength of steel by solid-solution and an effect of suppressing softening during tempering. In order to obtain the above-described effects, the Si content is necessarily 0.05% or more. On the other hand, when the Si content is high and more than 0.40%, the formation of ferrite phase as a soft phase is promoted so that desired high-strengthening is inhibited, and also the formation of coarse oxide-based inclusions is promoted so that SSC resistance and toughness deteriorate. In addition, Si is an element which locally hardens steel by segregation. Therefore, the high content of Si has an adverse effect in that a locally hard region is formed to deteriorate SSC resistance. Therefore, in the disclosed embodiments, the Si content is limited to a range of 0.05% to 0.40%. Preferably, the Si content is 0.05% to 0.30%. More preferably, the Si content is 0.20% to 0.30%.

Mn: 0.3% to 0.9%

Like C, Mn is an element which improves the hardenability of steel and contributes to an increase in the strength of steel. In order to obtain the above-described effects, the Mn content is necessarily 0.3% or more. On the other hand, Mn is an element which locally hardens steel by segregation. Therefore, the high content of Mn has an adverse effect in that a locally hard region is formed to deteriorate SSC resistance. Therefore, in the disclosed embodiments, the Mn content is limited to a range of 0.3% to 0.9%. Preferably, the Mn content is 0.4% to 0.8%. More preferably, the Mn content is 0.5% to 0.8%.

P: 0.015% or less

P is an element which not only causes grain boundary embrittlement by segregation in grain boundaries but also locally hardens steel by segregation therein. In the disclosed embodiments, P is an unavoidable impurity and it is preferable that the P content is reduced as much as possible. However, a P content of 0.015% or less is allowable. Therefore, the P content is limited to be 0.015% or less. Preferably, the P content is 0.012% or less.

S: 0.005% or less

S is an unavoidable impurity, and most of S in steel is present as a sulfide-based inclusion which deteriorates ductility, toughness, and SSC resistance. Therefore, it is preferable that the S content is reduced as much as possible. However, a S content of 0.005% or less is allowable. Therefore, the S content is limited to be 0.005% or less. Preferably, the S content is 0.003% or less.

Al: 0.005% to 0.1%

Al functions as a deoxidizer and contributes to the refining of austenite grains during heating by being bonded with N to form AlN. In addition, Al fixes N and prevents bonding of solid solute B with N to suppress a decrease in the effect of B improving the hardenability. In order to obtain the above-described effects, the Al content is necessarily 0.005 or more. On the other hand, the content of more than 0.1% of Al causes an increase in the amount of oxide-based inclusions, which decreases the cleanliness of steel to cause a deterioration in ductility, toughness, and SSC resistance. Therefore, the Al content is limited to a range of 0.005% to 0.1%. Preferably, the Al content is 0.01% to 0.08%. More preferably, the Al content is 0.02% to 0.05%.

N: 0.006% or less

N is present in steel as an unavoidable impurity. However, N has an effect of refining crystal grains and improving toughness when being bonded with Al to form. AlN or, in a case where Ti is contained, when being bonded with Ti to form TiN. However, the content of more than 0.006% of N coarsens nitrides to be formed and significantly deteriorates SSC resistance and toughness. Therefore, the N content is limited to be 0.006% or less.

Cr: more than 0.6% and 1.7% or less

Cr is an element which increases the strength of steel by improving hardenability and improves corrosion resistance. In addition, Cr is an element which is bonded with C to form a carbide such as $M_3C$, $M_7C_3$, or $M_{23}C_6$ (M represents a metal element) during a tempering treatment and improves tempering softening resistance and is an element required, particularly, for the high-strengthening of a steel pipe. In particular, a $M_3C$ carbide has a strong effect of improving tempering softening resistance. In order to obtain the above-described effects, the Cr content is necessarily more than 0.6%. On the other hand, when the Cr content is more than 1.7%, a large amount of $M_7C_3$ or $M_{23}C_6$ is formed and functions as a trap site for hydrogen to deteriorate SSC resistance. Therefore, the Cr content is limited to a range of more than 0.6% and 1.7% or less. Preferably, the Cr content is 0.8% to 1.5%. More preferably, the Cr content is 0.8% to 1.3%.

Mo: more than 1.0% and 3.0% or less

Mo is an element which forms a carbide and contributes to strengthening of steel through precipitation strengthening. Mo effectively contributes to securement of desired high strength after reduction dislocation density by tempering. Due to the reduction in dislocation density, SSC resistance is improved. In addition, Mo contributes to improvement of SSC resistance by forming solid solution in steel and segregates in prior austenite grain boundaries. Further, Mo has an effect of densifying a corrosion product and suppressing the formation and growth of a pit which causes cracking. In order to obtain the above-described effects, the Mo content is necessarily more than 1.0%. On the other hand, the content of more than 3.0% of Mo promotes the formation of a needle-like $M_2C$ precipitate or, in some cases, a Laves phase ($Fe_2Mo$) and deteriorates SSC resistance. Therefore, the Mo content is limited to a range of more than 1.0% and 3.0% or less. The Mo content is preferably more than 1.1% and 3.0% or less, more preferably more than 1.2% and 2.84 or less, and still more preferably 1.45% to 2.5%. Further, the Mo content is preferably 1.45% to 1.80%.

V: 0.02% to 0.3%

V is an element which forms a carbide or a carbonitride and contributes to strengthening of steel. In order to obtain the above-described effects, the V content is necessarily 0.02% or more. On the other hand, when the V content is more than 0.3%, the effect is saturated, and an effect corresponding to the content cannot be expected, which is economically disadvantageous. Therefore, the V content is limited to a range of 0.02% to 0.3%. The V content is preferably 0.03% to 0.20% and more preferably 0.15% or less Nb: 0001% to 0.02%

Nb forms a carbide or a carbonitride, contributes to an increase in the strength of steel through precipitation strengthening, and also contributes to the refining of austenite grains. In order to obtain the above-described effects, the Nb content is necessarily 0.001% or more. On the other hand, a Nb precipitate is likely to function as a propagation path of SSC (sulfide stress corrosion cracking), and the presence of a large amount of Nb precipitates owing to the high content of more than 0.02% of Nb leads to a significant deteriorate in SSC resistance, particularly, in the case of high-strength steel having a yield strength of 125 ksi or higher. Therefore, in the disclosed embodiments, the Nb content is limited to a range of 0.001% to 0.02% from the viewpoint of simultaneously realizing desired high strength and superior SSC resistance. Preferably, the Nb content is 0.001% or more and less than 0.01%.

B: 0.0003% to 0.0030%

B is segregated in austenite grain boundaries and suppresses ferrite transformation in the grain boundaries. As a result, even with a small content of B, an effect of improving the hardenability of steel can be obtained. In order to obtain the above-described effects, the B content is necessarily 0,0003% or more. On the other hand, when the B content is more than 0.0030%, B is precipitated as a carbonitride or the like, which deteriorates hardenability and accordingly deteriorates toughness. Therefore, the B content is limited to a range of 0.0003% to 0.0030%, Preferably, the B content is 0.0007% to 0.0025%.

O (oxygen): 0.0030% or less

O (oxygen) is an unavoidable impurity and is present in steel as an oxide-based inclusion. This inclusion causes SSC and deteriorates SSC resistance. Therefore, in the disclosed embodiments, it is preferable that the O (oxygen) content is reduced as much as possible. However, excessive reduction causes an increase in refining cost, and thus an O content of 0.0030% or less is allowable. Therefore, the O (oxygen) content is limited to be 0.0030% or less. Preferably, the O content is 0.0020%.

Ti: 0.003% to 0.025%

Ti is precipitated as fine TiN by being bonded with N during the solidification of molten steel and, due to the pinning effect thereof, contributes to the refining of austenite grains. In order to obtain the above-described effects, the Ti content is necessarily 0.003% or more. When the Ti content is less than 0.003%, the effect is low. On the other hand, when the Ti content is more than 0.025%, TiN is coarsened, above-described pinning effect cannot be exhibited, and toughness deteriorates. In addition, coarse TiN causes a deterioration in SSC resistance. Therefore, the Ti content, is limited to a range of 0.003% to 0.025%.

Ti/N: 2.0 to 5.0

When TiN is less than 2.0, the fixing of N is so insufficient that EN is formed, and the effect of B improving hardenability decreases. On the other hand, when Ti/N is more than 5.0, TiN is more likely to be coarsened, and toughness and SSC resistance deteriorate. Therefore, Ti/N is limited to a range of 2.0 to 5.0. Preferably, Ti/N is 2.5 to 4.5.

The above described elements are constituents of the basic composition. In addition to the basic composition, the high-strength seamless steel pipe according to the disclosed embodiments may further contain one element or two or more elements of Cu: 1.0% or less, Ni: 1.0% or less, and W: 3.0% or less and/or Ca: 0.0005% to 0.005% as optional elements.

One Element or Two or More Elements of Cu: 1.0% or Less, Ni: 1.0% or Less, and W: 3.0% or Less Cu, Ni, and W are elements which contribute to an increase in the strength of steel, and one element or two or more elements selected from these elements can be optionally contained.

Cu is an element which contributes to an increase in the strength of steel and has an effect of improving toughness and corrosion resistance e. In particular, Cu is extremely effective for improving SSC resistance in a severe corrosive environment. When Cu is contained, corrosion resistance is improved by a dense corrosion product being formed, and the formation and growth of a pit which causes cracking is suppressed. In order to obtain the above-described effects, the Cu content is preferably 0.03% or more. On the other hand, when the Cu content is more than 1.0%, the effect is saturated, and an effect corresponding to the content cannot be expected, which is economically disadvantageous. Therefore, when Cu is contained, it is preferable that the Cu content is limited to be 1.0% or less.

Ni is an element which contributes to an increase in the strength of steel and improves toughness and corrosion resistance. In order to obtain the above-described effects, the Ni content is preferably 0.03% or more. On the other hand, when the Ni content is more than 1.0%, the effect is saturated, and an effect corresponding to the content cannot be expected, which is economically disadvantageous. Therefore, when Ni is contained, it is preferable that the Ni content is limited to be 1.0% or less.

W is an element which forms a carbide, contributes to an increase in the strength of steel through precipitation strengthening, and also contributes to improvement of SSC resistance by forming solid-solution and segregated in prior austenite grain boundaries. In order to obtain the above-described effects, the W content s preferably 0.03% or more. On the other hand, when the W content is more than 3.0%, the effect is saturated, and an effect corresponding to the content cannot be expected, which is economically disadvantageous. Therefore, when W is contained, it is preferable that the W content is limited to be 3.0% or less.

Ca: 0.0005% to 0.005%

Ca is an element which is bonded with S to form CaS and efficiently serves to control the form of sulfide-based inclusions, and contributes to improvement of toughness and SSC resistance by shape control of sulfide-based inclusions. In order to obtain the above-described effects, the Ca content is necessarily at least 0.0005%. On the other hand, when the Ca content is more than 0.005%, the effect is saturated, and an effect corresponding to the content cannot be expected, which is economically disadvantageous. Therefore, when Ca is contained, it is preferable that the Ca content is limited to a range of 0.0005% to 0.005%.

A remainder other than the above-described components includes Fe and unavoidable impurities. As the unavoidable impurities, Mg: 0.0008% or less and Co: 0.05% or less are allowable.

The high-strength seamless steel pipe according to the disclosed embodiments has the above-described composition and the microstructure in which tempered martensite is a main phase being 95% or more in terms of volume fraction, prior austenite grains have a particle size number of 8.5 or more, and in a cross-section perpendicular to a rolling direction, the number of nitride-based inclusions having a particle size of 4 m or more is 100 or less per 100 $mm^2$, the number of nitride-based inclusions having a particle size of less than 4 μm is 1000 or less per 100 $mm^2$, the number of oxide-based inclusions having a particle size of 4 μm or more is 40 or less per 100 $mm^2$, and the number of oxide-based inclusions having a particle size of less than 4 μm is 400 or less per 100 $mm^2$.

Tempered martensitic phase: 95% or more

In the high strength seamless steel pipe according to the disclosed embodiments, in order to acquire a high strength of 125 ksi class or more YS with certainty and to maintain ductility and toughness necessary, for the steel pipe as a construction, a tempered martensitic phase formed by tempering the martensitic phase is set as a main phase. The "main phase" described herein represents a case where this phase is a single phase having a volume ratio of 100% or a case where this phase is contained in the microstructure at a volume ratio of 95% or more and a second phase is contained in the microstructure at a volume ratio of 5% or less that does not affect characteristics of the steel pipe. In the disclosed embodiments, examples of the second phase include hainite, remaining austenite, pearlite, and a mixed phase thereof.

In the high-strength seamless steel pipe according to the disclosed embodiments, the above-described microstructure can be adjusted by appropriately selecting a heating temperature during a quenching treatment and a cooling rate during cooling according to the composition of steel.

Grain Size Number of Prior Austenite Grains: 8.5 or More

When the grain size number of prior austenite grains is less than. 8.5, a substructure of martensite to be formed is coarsened, and SSC resistance deteriorates. Therefore, the grain size number of prior austenite grains is limited to be 8.5 or more. The grain size number used herein is a value measured according to JIS G 0551 is used.

In the disclosed embodiments, the grain size number of prior austenite grains can be adjusted by changing a heating rate, a heating temperature, and a holding temperature during a quenching treatment and changing the number of times of performing quenching treatments.

Further, in the high-strength seamless steel pipe according to the disclosed embodiments, in order to improve SSC resistance, the numbers of nitride-based inclusions and oxide-based inclusions are adjusted to be in appropriate ranges depending on the sizes. Nitride-based inclusions and oxide-based inclusions are identified by automatic detection using a scanning electron microscope. The nitride-based inclusions contain Ti and Nb as major components, and the oxide-based inclusions contain Al, Ca, and Mg as major components. The numbers of the inclusions are values measured in a cross-section perpendicular to a rolling direction of the steel pipe (cross-section perpendicular to a pipe axis direction: C cross-section). As the sizes of the inclusions, particle sizes of the respective inclusions are used. Regarding the particle sizes of the inclusions, the areas of inclusion grains are obtained, and circle equivalent diameters thereof are calculated to obtain the particle sizes of the inclusion particles.

Number of Nitride-Eased Inclusions Having Particle Size of 4 μm or More: 100 or Less per 100 $mm^2$ Nitride-based inclusions causes SSC in the high-strength steel pipe having a yield strength of 125 ksi or higher, and as the size thereof increases to be 4 μm or more, an adverse effect thereof increases. Therefore, it is preferable that the number of nitride-based inclusions having a particle size of 4 μm or more decreases as much as possible. However, when the number of nitride-based inclusions having a particle size of 4 μm or more is 100 or less per 100 $mm^2$, an adverse effect on SSC resistance is allowable. Therefore, the number of nitride-based inclusions having a particle size of 4 μm or more is limited to be 100 or less per 100 $mm^2$. Preferably, the number of nitride-based inclusions having a particle size of 4 μm or more is 84 or less.

Number of Nitride-Eased Inclusions Having Particle Size of Less Than 4 μm: 1000 or Less per 100 $mm^2$ The presence of a single fine nitride-based inclusions having a particle size of less than 4 μm does hot cause SSC. However, in the high-strength steel pipe having a yield strength YS of 125 ksi or higher, when the number of nitride-based inclusions having a particle size of less than 4 μm is more than 1000 per 100 $mm^2$, an adverse effect thereof on SSC resistance is not allowable. Therefore, the number of nitride-based inclusions having a particle size of less than 4 μm is limited to be 1000 or less per 100 $mm^2$. Preferably, the number of nitride-based inclusions having a particle size of less than 4 μm is 900 or less.

Number of Oxide-Based Inclusions Having Particle Size of 4 μm or More: 40 or Less per 100 $mm^2$ Oxide-based inclusions causes SSC in the high-strength steel pipe having a yield strength YS of 125 ksi or higher, and as the size thereof increases to be 4 μm or more, an adverse effect thereof becomes large. Therefore, it is desirable that the number of oxide-based inclusions having a particle size of 4 μm or more decreases as much as possible. However, when the number of oxide-based inclusions having a particle size of 4 μm or more is 40 or less per 100 $mm^2$, an adverse effect thereof on SSC resistance is allowable. Therefore, the number of oxide-based inclusions having a particle size of 4 μm or more is limited to be 40 or less per 100 $mm^2$. Preferably, the number of oxide-based inclusions having a particle size of 4 μm or more is 35 or less.

Number of Oxide-Based Inclusions Having Particle Size of Less Than 4 pin: 400 or Less per 100 $mm^2$ Even a small oxide-based inclusion having a particle size of less than 4 μm causes SSC in the high-strength steel pipe having a yield strength of 125 ksi or higher, and as the number thereof increases, an adverse effect thereof on SSC resistance becomes large. Therefore, it is preferable that number of oxide-based inclusions having a particle size of less than 4 μm decreases as much as possible. However, when the number of oxide-based inclusions having a particle size of less than 4 μm is 400 or less per 100 $mm^2$, an adverse effect thereof on SSC resistance is allowable. Therefore, the number of oxide-based inclusions having a particle size of less than 4 pin is limited to be 400 or less per 100 $mm^2$. Preferably, the number of oxide-based inclusions having a particle size of less than 4 μm is 365 or less.

In the disclosed embodiments, in order to adjust the numbers of nitride-based inclusions and oxide-based inclusions, in particular, control in a refining process of molten steel is important. Desulfurization and dephosphorization are performed in a pretreatment of hot metal, decarburization and dephosphorization are performed in a converter, and then a heating-stirring-refining treatment (LF) and a RH vacuum degassing treatment are performed in a ladle. The treatment time of the heating-stirring-refining treatment (LF) is sufficiently secured and the treatment time of the RH vacuum degassing treatment is secured. In addition, en a cast bloom (steel pipe raw material) is prepared by a continuous casting method, the molten steel is teemed from the ladle into a tundish while the molten steel is sealed using inert gas, and in addition, the molten steel is electromagnetically stirred in a mold in order to separate inclusions by flotation such that the numbers of nitride-based inclusions and oxide-based inclusions per unit area are the above-described values or less.

Next, a method of producing a high-strength seamless steel pipe according to the disclosed embodiments will be described.

In the disclosed embodiments, the steel pipe raw material having the above-described composition is heated, and hot working is performed on the heated steel pipe raw material to form a seamless steel pipe having a predetermined shape.

It is preferable that the steel pipe raw material used in the disclosed embodiments is prepared by preparing molten steel having the above-described composition with a commonly-used melting method using a converter or the like and obtaining a cast bloom (round cast block) using a commonly-used casting method such as a continuous casting method. Further, the cast bloom may be hot-rolled into a round steel block having a predetermined shape. Alternatively, a round steel block may be produced by ingot making and blooming process.

In the high-strength seamless eel pipe according to the disclosed embodiments, in order to further improve SSC resistance, the numbers of nitride-based inclusions and oxide-based inclusions per unit area are reduced to be the above-described values or less. Therefore, in the steel pipe raw material (cast bloom or steel block), it is necessary to reduce the N content and the O content as much as possible so as to satisfy the ranges of N (nitrogen): 0.006% or less and O (oxygen): 0.00306 or less.

In order to adjust the numbers of nitride-based inclusions and oxide-based inclusions per unit area to be the above-described values or less, control in the refining process of molten steel is important. In the disclosed embodiments, it is preferable to perform desulfurization and dephosphorization in a pretreatment of hot metal, to perform decarburization and dephosphorization in a converter, and then to perform a heating-stirring-refining treatment (LF) and a RH vacuum degassing treatment in a ladle. As the LF time increases, the CaO concentration or the CaS concentration in the inclusion decreases and $MgO—Al_2O_3$ inclusions are formed, so that SSC resistance is improved. In addition, when the RH time increases, the oxygen concentration in the molten steel decreases so that the size of the oxide-based inclusions decreases and the number thereof decreases. Therefore, it is preferable that the treatment time of the heating-stirring-refining treatment (LF) is 30 minutes or longer, the treatment time of the RH vacuum degassing treatment is 20 minutes or longer.

In addition, in order to prepare a cast bloom (steel pipe raw material) using a continuous casting method, it is preferable that the molten steel is sealed with inert gas while being teemed from the ladle into a tundish such that the numbers of nitride-based inclusions and oxide-based inclusions per unit area are the above-described values or less. In addition, it is preferable that the molten steel is electromagnetically stirred in a mold to separate inclusions by flotation. As a result, the amounts and sizes of nitride-based inclusions and oxygen-based inclusions can be adjusted.

Next, the cast bloom (steel pipe raw material) having the above-described composition is heated to a heating temperature of 1050° C. to 1350° C. and is subjected to hot working to form a seamless steel pipe having a predetermined dimension.

Heating Temperature: 1050° C. to 1350° C.

When the heating temperature is lower than 1050° C., the dissolving of carbides in the steel pipe raw material is insufficient. On the other hand, when the steel raw material is heated to higher than 1350° C., crystal grains are coarsened, precipitates such as TiN precipitated during solidification are coarsened, and cementite is coarsened. As a result, the toughness of the steel pipe deteriorates. In addition, when the steel raw material is heated to a high temperature of higher than 1350° C., a thick scale layer is formed on the surface thereof, which causes surface defects to be generated during rolling. In addition, the energy loss increases, which is not desirable from the viewpoint of energy saving. Therefore, the heating temperature is limited to be in a range of 1050° C. to 1350° C., Preferably, the heating temperature is in a range of 1100° C. to 1300° C.

Next, hot working (pipe making) is performed on the heated steel pipe raw material using a hot rolling mill of the Mannesmann-plug mill process or the Mannesmann-mandrel mill process to form a seamless steel pipe having a predetermined dimension. The seamless steel pipe may be obtained by hot extrusion using a pressing process.

After the completion of the hot working, the obtained seamless steel pipe is subjected to a cooling treatment, in which the seamless steel pipe is cooled at a cooling rate equal to or higher than that of air cooling until a surface temperature thereof reaches 200° C. or lower.

Cooling Treatment after Completion of Hot Working: Cooling Rate: Air Cooling Rate or Higher, Cooling Stop Temperature: 200° C. or Lower When the seamless steel pipe in the composition range according to the disclosed embodiments is cooled at a cooling rate equal to or higher than that of air cooling after the hot working, a microstructure containing martensite as a main phase can be obtained. When air cooling (cooling) stopped at a surface temperature of higher than 200° C., the transformation may not be fully completed. Therefore, after the hot working, the seamless steel pipe is cooled at a cooling rate equal to or higher than that of air cooling until the surface temperature thereof reaches 200° C. or lower. Here, in the disclosed embodiments, "the cooling rate equal to or higher than that of air cooling" represents 0.1° C./s or higher. When the cooling rate lower than 0.1° C./s, a metallographic microstructure after the cooling is non-uniform, which causes a non-uniform metallographic microstructure after a heat treatment subsequent to the cooling.

After the cooling treatment of cooling the seamless steel pipe at a cooling rate equal to or higher than that of air cooling, a tempering treatment is performed. In the tempering treatment, the seamless steel pipe is heated at a temperature in a range of 670° C. to 740° C.

Tempering Temperature: 600° C. to 740° C.

The tempering treatment is performed in order to decrease the dislocation density to improve toughness and SSC resistance. When the tempering temperature is lower than 600° C., a decrease in dislocation is insufficient, and thus superior SSC resistance cannot be secured. On the other hand, when the tempering temperature is higher than 740° C., the softening of the microstructure becomes significant, and desired high strength cannot be secured. Therefore, the tempering temperature is limited to a temperature in a range of 600° C. 740° C. Preferably, the tempering temperature is in a range of 670° C. to 710° C.

In order to stably secure desired characteristics, after the hot working and the cooling treatment of cooling the seamless steel pipe at a cooling rate equal to or higher than that of air cooling, a quenching treatment is performed in which the seamless steel pipe is reheated and rapidly cooled by water cooling or the like. Next, the above-described tempering treatment is performed.

Reheating Temperature During Quenching Treatment: From $Ac_3$ Transformation. Point to 1000° C.

When the reheating temperature is lower than an $Ac_3$ transformation point, the seamless steel pipe is not heated to an austenite single-phase region. Therefore, a microstructure containing martensite as a main phase cannot be obtained. On the other hand, when the reheating temperature is higher than 1000° C., there are various adverse effects. For example, crystal grains are coarsened, toughness deteriorates, the thickness of oxide scale on the surface increases, and peeling is likely to occur, which causes defects to be generated on the surface of the steel pipe. Further, an excess amount of load is applied to a heat treatment furnace, which causes a problem from the viewpoint of energy saving. Therefore, from the viewpoint of energy saving, the reheating temperature during the quenching treatment is limited to a range of an $Ac_3$ transformation point to 1000° C. Preferably, the reheating temperature during the quenching treatment is 950° C. or lower.

In addition, in the quenching treatment, it is preferable that the cooling after reheating is performed by water cooling at an average cooling rate of 2° C./s or more until the temperature at a center of thickness reaches 400° C. or lower, and then is performed until the surface temperature reaches 200° C. or lower and preferably 100° C. or lower. The quenching treatment may be repeated twice or more.

As the $Ac_3$ transformation point, a value calculated from the following equation should be used.

$$Ac_3 \text{ transformation point } (^\circ\text{ C.}) = 937 - 476.\ ^\circ C + 56Si - 19.7Mn - 16.3Cu - 4.9Cr - 26.6Ni + 38.1Mo + 124.8V + 1\ 36.3Ti + 198Al + 3315B$$

(where, C, Si, Mn, Cu, Cr, Ni, Ma, V, Ti, Al, B: content (mass %) of each element)

In the calculation of the $Ac_3$ transformation point, when an element shown in the above-described equation is not contained, the content of the element is calculated as 0%.

After the quenching treatment and the tempering treatment, optionally, a correction treatment of correcting shape defects of the steel pipe may be performed in a warm or cool environment.

EXAMPLES

Hereinafter, the disclosed embodiments will be described in more detail based on the following Examples.

Regarding molten iron tapped from a blast furnace, desulfurization and dephosphorization were performed in a hot metal pretreatment, decarburization and dephosphorization were performed in a converter, a heating-stirring-refining treatment (LF) was performed under conditions of a treatment time of 60 minutes as shown in Table 2, and a RH vacuum degassing treatment was performed under conditions of a reflux amount of 120 ton/min and a treatment time of 10 minutes to 40 minutes. As a result, molten steel having a composition shown in Table 1 was obtained, and a cast bloom (round cast block: 190 mmϕ) was obtained using a continuous casting method. In the continuous casting method, Ar gas shielding in a tundish were performed except for Steel No. P and No. R and electromagnetic stirring in a mold were performed except for Steel No. N and No. R.

The obtained cast bloom was charged into a heating furnace as a steel pipe raw material, was heated to a heating temperature shown in Table 2, and was held at this temperature (holding time: 2 hours) Hot working was performed on the heated steel pipe raw material using a hot rolling mill of the Mannesmann-plug mill process to form a seamless steel pipe (outer diameter 100 mmϕ to 200 mmϕ×thickness 12 mm to 30 mm). After the hot working, air cooling was performed, and quenching and tempering treatments were performed under conditions shown in Table 2. Regarding some of the seamless steel pipes, after the hot working, water cooling was performed, and then a tempering treatment or quenching and tempering treatments were performed.

A specimen was collected from each of the obtained seamless steel pipes, and microstructure observation, a tensile test, and a sulfide stress corrosion cracking test were performed. Test methods were as follows.

(1) Microstructure Observation

A specimen for microstructure observation was collected from an inner surface-side 1/4 t position (t: wall thickness) of each of the obtained seamless steel pipes A cross-section (C cross-section) perpendicular to a pipe longitudinal direction was polished and was etched (Nital (nitric acid-ethanol mixed solution) etching) to expose a microstructure. The exposed microstructure was observed and the images were taken by using an optical microscope (magnification: 1000 times) and a scanning electron microscope (magnification: 2000 times to 3000 times) in four or more fields of view. By analyzing the obtained microstructure images, phases constituting the microstructure were identified, and a ratio of the phases in the microstructure were calculated.

In addition, using the specimen for microstructure observation, the grain sizes of prior austenite (γ) grains were measured. The cross-section (C cross-section) of the specimen for microstructure observation perpendicular to the pipe longitudinal direction was polished and was etched (with Picral solution (picric acid-ethanol mixed solution) to expose prior γ grain boundaries. The exposed prior γ grain boundaries were observed and the images were taken by using an optical microscope (magnification: 1000 times) in three or more fields of view. From the obtained microstructure images, the grain size number of prior γ grains was obtained using a cutting method according to JIS S 0551.

In addition, regarding the specimen for microstructure observation, the microstructure in a region having a size of 400 $mm^2$ was observed using a scanning electron microscope (magnification: 2000 times to 3000 times). Inclusions were automatically detected based on the light and shade of the images. Concurrently, the quantitative analysis of the inclusions was automatically performed using an EDX provided in the scanning electron microscope to measure the kinds, sizes, and numbers of the inclusions. The kinds of the inclusions were determined based on the quantitative analysis using the EDX. The inclusions containing Ti and Nb as major components were classified into nitride-based inclusions and the inclusions containing Al, Ca, and Mg as major components were classified into oxide-based inclusions. "Major components" described herein represent the components in a case where the content of the elements is 65% or more in total.

In addition, the numbers of particles identified as inclusions were obtained. Further, the areas of the respective particles were obtained, and circle equivalent diameters thereof were calculated to obtain the particle sizes of the inclusions. The number densities (particles/100 $mm^2$) of inclusions having a particle size of 4 μm or more and inclusions having a particle size of less than 4 μm were calculated. Inclusions having a long side length of shorter than 2 μm were not analyzed.

(2) Tensile Test

JIS No. 10 specimen for a tensile test (bar specimen: diameter of parallel portion: 12.5 mmϕ, length of parallel portion: 60 mm, GL: 50 mm) was taken from an inner surface-side 1/4 t position (t: wall thickness) of each of the obtained seamless steel pipes according to JIS Z 2241 such that a tensile direction was a pipe axis direction. Using this specimen, the tensile test was performed to obtain tensile characteristics (yield strength YS (0.5% yield strength), tensile strength TS).

(3) Sulfide Stress Corrosion Cracking Test

A specimen for a tensile test (diameter of parallel portion; 6.35 mmϕ×length of parallel portion: 25.4 mm) was taken from a part centering an inner surface-side 1/4 t position (t:

pipe thickness (mm)) of each of the obtained seamless steel pipes such that a pipe axis direction was a tensile direction.

Using the above described specimen for a tensile test, a sulfide stress corrosion cracking test was performed according to a test method defined in NACE TMO177 Method A. The sulfide stress corrosion cracking test was a constant-load test in which the above-described specimen for a tensile test was dipped in a test solution (an acetic acid-sodium acetate solution (liquid temperature: 24° C.) saturated with hydrogen sulfide at 10 kPa, having an adjust d pH of 3.5, and containing 5.0 mass % of sodium chloride solution) and was held with an applied load of 85% of yield strength YS. The evaluation "○: good" (pass) was given to cases where the specimen was not broken before 720 hours, and the evaluation "×: bad" (rejection) was given to other cases where the specimen was broken before 720 hours. In the case when a target yield strength was not secured, the sulfide stress corrosion cracking test was not performed.

The obtained results are shown in Table 3.

TABLE 1

| | Chemical Composition (mass %) | | | | | | | | | | |
|---|---|---|---|---|---|---|---|---|---|---|---|
| Steel No. | C | Si | Mn | P | S | Al | N | Cr | Mo | V | Nb |
| A | 0.27 | 0.23 | 0.75 | 0.006 | 0.0017 | 0.042 | 0.0015 | 1.44 | 1.61 | 0.150 | 0.006 |
| B | 0.26 | 0.25 | 0.64 | 0.012 | 0.0011 | 0.035 | 0.0034 | 0.92 | 2.22 | 0.110 | 0.003 |
| C | 0.33 | 0.26 | 0.42 | 0.008 | 0.0009 | 0.027 | 0.0052 | 1.22 | 1.78 | 0.055 | 0.009 |
| D | 0.29 | 0.25 | 0.39 | 0.010 | 0.0012 | 0.033 | 0.0044 | 1.32 | 1.90 | 0.035 | 0.002 |
| E | 0.28 | 0.23 | 0.44 | 0.008 | 0.0015 | 0.035 | 0.0028 | 0.98 | 1.65 | 0.022 | 0.007 |
| F | 0.32 | 0.13 | 0.55 | 0.011 | 0.0018 | 0.035 | 0.0033 | 1.05 | 1.10 | 0.075 | 0.008 |
| G | 0.18 | 0.35 | 0.65 | 0.008 | 0.0013 | 0.036 | 0.0034 | 1.25 | 1.25 | 0.180 | 0.006 |
| H | 0.52 | 0.11 | 0.34 | 0.012 | 0.0014 | 0.034 | 0.0030 | 1.52 | 1.66 | 0.026 | 0.006 |
| I | 0.26 | 0.23 | 0.46 | 0.009 | 0.0017 | 0.038 | 0.0042 | 1.43 | 0.93 | 0.063 | 0.005 |
| J | 0.25 | 0.25 | 0.45 | 0.011 | 0.0009 | 0.041 | 0.0042 | 0.55 | 1.90 | 0.055 | 0.007 |
| K | 0.33 | 0.25 | 0.58 | 0.012 | 0.0010 | 0.045 | 0.0041 | 1.32 | 1.75 | 0.044 | 0.026 |
| L | 0.34 | 0.26 | 0.69 | 0.009 | 0.0020 | 0.030 | 0.0045 | 1.35 | 1.65 | 0.037 | 0.006 |
| M | 0.33 | 0.26 | 0.71 | 0.013 | 0.0008 | 0.028 | 0.0068 | 1.25 | 1.65 | 0.038 | 0.007 |
| N | 0.32 | 0.27 | 0.70 | 0.014 | 0.0008 | 0.025 | 0.0035 | 1.12 | 1.81 | 0.082 | 0.006 |
| O | 0.28 | 0.25 | 0.65 | 0.008 | 0.0011 | 0.035 | 0.0058 | 1.34 | 1.62 | 0.050 | 0.008 |
| P | 0.25 | 0.33 | 0.72 | 0.006 | 0.0009 | 0.021 | 0.0072 | 1.46 | 0.89 | 0.098 | 0.008 |
| Q | 0.27 | 0.25 | 0.59 | 0.010 | 0.0009 | 0.035 | 0.0035 | 0.86 | 1.51 | 0.062 | 0.012 |
| R | 0.32 | 0.31 | 0.46 | 0.012 | 0.0013 | 0.035 | 0.0041 | 1.12 | 1.33 | 0.035 | 0.015 |

| | Chemical Composition (mass %) | | | | | | |
|---|---|---|---|---|---|---|---|
| Steel No. | B | Ti | Cu, Ni, W | Ca | O | Ti/N | Note |
| A | 0.0022 | 0.004 | — | — | 0.0015 | 2.7 | Suitable Example |
| B | 0.0015 | 0.015 | Ni: 0.15 | — | 0.0009 | 4.4 | Suitable Example |
| C | 0.0012 | 0.014 | — | 0.0012 | 0.0008 | 2.7 | Suitable Example |
| D | 0.0009 | 0.019 | Cu: 0.75 | — | 0.0007 | 4.3 | Suitable Example |
| E | 0.0025 | 0.008 | Cu: 0.45, Ni: 0.23 | 0.0014 | 0.0009 | 2.9 | Suitable Example |
| F | 0.0023 | 0.012 | W: 1.40 | — | 0.0011 | 3.6 | Suitable Example |
| G | 0.0014 | 0.009 | Ni: 0.32 | 0.0017 | 0.0014 | 2.6 | Comparative Example |
| H | 0.0021 | 0.013 | — | — | 0.0010 | 4.3 | Comparative Example |
| I | 0.0022 | 0.014 | — | — | 0.0009 | 3.3 | Comparative Example |
| J | 0.0014 | 0.015 | — | — | 0.0008 | 3.6 | Comparative Example |
| K | 0.0016 | 0.019 | — | — | 0.0007 | 4.6 | Comparative Example |
| L | 0.0024 | 0.023 | Cu: 0.25 | — | 0.0013 | 5.1 | Comparative Example |
| M | 0.0011 | 0.012 | Cu: 0.15, Ni: 0.10 | 0.0021 | 0.0018 | 1.8 | Comparative Example |
| N | 0.0019 | 0.015 | Cu: 0.25 | 0.0028 | 0.0035 | 4.3 | Comparative Example |
| O | 0.0015 | 0.026 | — | — | 0.0015 | 4.5 | Comparative Example |
| P | 0.0017 | 0.020 | — | — | 0.0035 | 2.8 | Comparative Example |
| Q | 0.0020 | 0.015 | — | — | 0.0012 | 4.3 | Suitable Example |
| R | 0.0012 | 0.021 | — | — | 0.0014 | 5.1 | Suitable Example |

Components other than the above-described elements were Fe and unavoidable impurities.

TABLE 2

| Steel Pipe No. | Steel No. | Refining Treatment Time (min)***** LF | Refining Treatment Time (min)***** RH | Casting Sealing ****** | Casting Electromagnetic Stirring ******* | Heating Heating Temperature (° C.) | Pipe Dimension Outer Diameter (mmϕ) | Pipe Dimension Thickness (mm) | Cooling after Hot Working Cooling | Cooling after Hot Working Cooling Stop Temperature *(° C.) | Quenching Treatment Quenching Temperature **(° C.) | Quenching Treatment Cooling Stop Temperature ***(° C.) | Tempering Treament Tempering Temperature (° C.) | $Ac_3$ Transformation Point (° C.) | Note |
|---|---|---|---|---|---|---|---|---|---|---|---|---|---|---|---|
| 1 | A | 50 | 20 | ○ | ○ | 1200 | 160 | 19 | Air Cooling | ≤100 | 900 | 150 | 695 | 895 | Example |
| 2 | A | 50 | 20 | ○ | ○ | 1200 | 200 | 25 | Air Cooling | ≤100 | 900<br>890**** | 150<br>150**** | 705 | 895 | Example |
| 3 | B | 60 | 30 | ○ | ○ | 1200 | 160 | 19 | Air Cooling | ≤100 | 925 | 150 | 715 | 918 | Example |
| 4 | B | 60 | 30 | ○ | ○ | 1200 | 100 | 12 | Air Cooling | ≤100 | 925 | <100 | 715 | 918 | Example |
| 5 | B | 60 | 30 | ○ | ○ | 1200 | 160 | 19 | Water Cooling | 200 | — | — | 690 | 918 | Example |
| 6 | B | 60 | 30 | ○ | ○ | 1200 | 160 | 19 | Water Cooling | 200 | 925 | 150 | 710 | 918 | Example |
| 7 | B | 60 | 30 | ○ | ○ | 1200 | 200 | 25 | Air Cooling | ≤100 | 925 | <100 | 705 | 918 | Example |
| 8 | C | 45 | 40 | ○ | ○ | 1200 | 160 | 19 | Air Cooling | ≤100 | 890 | <100 | 710 | 866 | Example |
| 9 | C | 45 | 40 | ○ | ○ | 1200 | 160 | 19 | Air Cooling | ≤100 | 1030 | <100 | 710 | 866 | Comparative Example |
| 10 | D | 50 | 40 | ○ | ○ | 1200 | 160 | 19 | Air Cooling | ≤100 | 930 | <100 | 700 | 875 | Example |
| 11 | E | 50 | 30 | ○ | ○ | 1200 | 160 | 19 | Air Cooling | ≤100 | 900 | <100 | 680 | 871 | Example |
| 12 | E | 50 | 30 | ○ | ○ | 1200 | 160 | 19 | Air Cooling | ≤100 | 910 | <100 | 760 | 871 | Comparative Example |
| 13 | E | 50 | 30 | ○ | ○ | 1200 | 160 | 19 | Air Cooling | ≤100 | 895 | 325 | 670 | 871 | Comparative Example |
| 14 | F | 60 | 30 | ○ | ○ | 1200 | 160 | 19 | Air Cooling | ≤100 | 900 | <100 | 700 | 843 | Example |
| 16 | G | 30 | 30 | ○ | ○ | 1200 | 160 | 19 | Air Cooling | ≤100 | 930 | <100 | 680 | 926 | Comparative Example |
| 17 | H | 40 | 30 | ○ | ○ | 1200 | 160 | 19 | Air Cooling | ≤100 | 900 | <100 | 685 | 763 | Comparative Example |
| 18 | I | 40 | 30 | ○ | ○ | 1200 | 160 | 19 | Air Cooling | ≤100 | 900 | <100 | 690 | 870 | Comparative Example |
| 19 | J | 40 | 30 | ○ | ○ | 1200 | 160 | 19 | Air Cooling | ≤100 | 920 | <100 | 705 | 914 | Comparative Example |
| 20 | K | 40 | 30 | ○ | ○ | 1200 | 160 | 19 | Air Cooling | ≤100 | 930 | <100 | 705 | 865 | Comparative Example |
| 21 | L | 40 | 30 | ○ | ○ | 1200 | 160 | 19 | Air Cooling | ≤100 | 900 | <100 | 705 | 850 | Comparative Example |
| 22 | M | 40 | 30 | ○ | ○ | 1200 | 160 | 19 | Air Cooling | ≤100 | 900 | <100 | 705 | 847 | Comparative Example |
| 23 | N | 30 | 10 | ○ | X | 1200 | 160 | 19 | Air Cooling | ≤100 | 900 | <100 | 705 | 869 | Comparative Example |
| 24 | O | 30 | 10 | ○ | ○ | 1200 | 160 | 19 | Air Cooling | ≤100 | 900 | <100 | 695 | 881 | Comparative Example |
| 25 | P | 30 | 30 | X | ○ | 1200 | 160 | 19 | Air Cooling | ≤100 | 900 | 150 | 695 | 874 | Comparative Example |

TABLE 2-continued

| Steel Pipe No. | Steel No. | Refining Treatment Time (min)***** LF | Refining Treatment Time (min)***** RH | Casting Sealing ****** | Casting Electromagnetic Stirring ******* | Heating Heating Temperature (° C.) | Pipe Dimension Outer Diameter (mmϕ) | Pipe Dimension Thickness (mm) | Cooling after Hot Working Cooling | Cooling after Hot Working Cooling Stop Temperature *(° C.) | Quenching Treatment Quenching Temperature **(° C.) | Quenching Treatment Cooling Stop Temperature ***(° C.) | Tempering Treament Tempering Temperature (° C.) | $Ac_3$ Transformation Point (° C.) | Note |
|---|---|---|---|---|---|---|---|---|---|---|---|---|---|---|---|
| 26 | Q | 50 | 30 | ○ | ○ | 1200 | 230 | 30 | Air Cooling | ≤100 | 910 | 150 | 700 | 887 | Example |
| 27 | R | 20 | 15 | X | X | 1200 | 230 | 30 | Air Cooling | ≤100 | 910 | 150 | 700 | 856 | Comparative Example |

*Cooling stop temperature: surface temperature
**Reheating temperature
***Quenching cooling stop temperature: surface temperature
****Second quenching treatment
*****LF: heating-stirring-refining treatment, RH: vacuum degassing treatment
******Sealing during teeming from ladle into tundish, Performed: ○, Not Performed: X
*******Electromagnetic stirring in mold, Performed: ○, Not Performed: X

TABLE 3

| Steel Pipe No. | Steel No. | Microstructure: Number Density of Nitride-Based Inclusions* Less Than 4 μm | Number Density of Nitride-Based Inclusions* 4 μm or more | Number Density of Oxide-Based Inclusions* Less Than 4 μm | Number Density of Oxide-Based Inclusions* 4 μm or more | Kind** | Ratio of TM Microstructure (vol %) | Grain Size Number of Prior γ Grains | Tensile Characteristics: Yield Strength YS (MPa) | Tensile Strength TS (MPa) | SSC Resistance | Note |
|---|---|---|---|---|---|---|---|---|---|---|---|---|
| 1 | A | 495 | 21 | 299 | 35 | TM + B | 98 | 9.5 | 880 | 967 | ○: good | Example |
| 2 | A | 462 | 28 | 356 | 32 | TM + B | 98 | 11.0 | 915 | 988 | ○: good | Example |
| 3 | B | 886 | 73 | 205 | 16 | TM + B | 98 | 10.0 | 873 | 970 | ○: good | Example |
| 4 | B | 884 | 69 | 215 | 15 | TM + B | 98 | 10.5 | 866 | 949 | ○: good | Example |
| 5 | B | 851 | 78 | 192 | 18 | TM + B | 98 | 8.5 | 920 | 1002 | ○: good | Example |
| 6 | B | 870 | 84 | 188 | 21 | TM + B | 99 | 10.5 | 892 | 963 | ○: good | Example |
| 7 | B | 865 | 75 | 190 | 19 | TM + B | 98 | 10.5 | 889 | 982 | ○: good | Example |
| 8 | C | 785 | 77 | 198 | 16 | TM + B | 98 | 10.5 | 925 | 997 | ○: good | Example |
| 9 | C | 773 | 81 | 212 | 18 | TM + B | 99 | 8.0 | 942 | 1019 | X: bad | Comparative Example |
| 10 | D | 896 | 84 | 187 | 20 | TM + B | 98 | 10.5 | 997 | 1034 | ○: good | Example |
| 11 | E | 454 | 53 | 233 | 28 | TM + B | 98 | 10.0 | 938 | 1013 | ○: good | Example |
| 12 | E | 441 | 49 | 240 | 29 | TM + B | 98 | 10.5 | 828 | 916 | — | Comparative Example |
| 13 | E | 436 | 61 | 265 | 19 | TM + B | 80 | 10.5 | 806 | 896 | — | Comparative Example |
| 14 | F | 576 | 68 | 334 | 29 | TM + B | 98 | 10.5 | 928 | 1009 | ○: good | Example |
| 16 | G | 379 | 53 | 265 | 17 | TM + B | 98 | 10.5 | 815 | 899 | — | Comparative Example |
| 17 | H | 656 | 49 | 287 | 18 | TM + B | 98 | 10.5 | 1094 | 1164 | X: bad | Comparative Example |
| 18 | I | 758 | 33 | 292 | 22 | TM + B | 98 | 10.5 | 998 | 1039 | X: bad | Comparative Example |
| 19 | J | 855 | 71 | 233 | 25 | TM + B | 98 | 10.5 | 986 | 1060 | X: bad | Comparative Example |
| 20 | K | 920 | 165 | 188 | 14 | TM + B | 96 | 11.0 | 864 | 986 | X: bad | Comparative Example |
| 21 | L | 1326 | 85 | 244 | 24 | TM + B | 98 | 10.5 | 978 | 1034 | X: bad | Comparative Example |
| 22 | M | 632 | 128 | 306 | 31 | TM + B | 98 | 10.5 | 878 | 986 | X: bad | Comparative Example |
| 23 | N | 864 | 25 | 622 | 33 | TM + B | 98 | 10.5 | 868 | 941 | X: bad | Comparative Example |
| 24 | O | 1462 | 137 | 274 | 19 | TM + B | 98 | 10.0 | 885 | 985 | X: bad | Comparative Example |
| 25 | P | 765 | 84 | 944 | 132 | TM + B | 98 | 9.5 | 876 | 965 | X: bad | Comparative Example |
| 26 | Q | 675 | 21 | 236 | 23 | TM + B | 98 | 11.5 | 926 | 992 | ○: good | Example |
| 27 | R | 1220 | 213 | 495 | 166 | TM + B | 98 | 12.0 | 930 | 1018 | X: bad | Comparative Example |

*Number Density: particles/100 $mm^2$
**TM: tempered martensite, B: bainite

In all the seamless steel pipes of Examples according to the disclosed embodiments, a high yield strength YS of 862 MPa or higher and superior SSC resistance were obtained. On the other hand, in the seamless steel pipes of Comparative Examples which were outside of the ranges of the disclosed embodiments, a desired high strength was not able to be secured due to low yield strength YS, or SSC resistance deteriorated.

In Steel Pipe No. 9 in which the quenching temperature was higher than the range of the disclosed embodiments, prior austenite grains were coarsened, and SSC resistance deteriorated. In addition, in Steel Pipe No. 12 in which the tempering temperature was higher than the range of the disclosed embodiments, the strength decreased. In addition, in Steel Pipe No. 13 in which the cooling stop temperature of the quenching treatment was higher than the range of the disclosed embodiments, the desired microstructure containing martensite as a main phase was not able to be obtained, and the strength decreased. In addition, in Steel Pipe No. 15 in which the tempering temperature was lower than the range of the disclosed embodiments, SSC resistance deteriorated. In addition, in Steel Pipe No. 16 in which the C content was lower than the range of the disclosed embodiments, the desired high strength was not able to be secured. In addition, in Steel Pipe No. 17 in which the C content was higher than the range of the disclosed embodiments, the strength increased, and SSC resistance deteriorated at the tempering temperature in the range of the disclosed embodiments. In addition, in Steel Pipes No, 18 d No 19 in which the Mo content and the Cr content were lower than the ranges of the disclosed embodiments, the desired high strength was able to be secured, but SSC resistance deteriorated. In addition, in Steel Pipe No. 20 in which the Nb content was higher than the range of the disclosed embodiments, the desired high strength was able to be secured, but SSC resistance deteriorated. In addition, in Steel Pipes No. 21 to No. 25 in which the numbers of the inclusions were outside of the ranges of the disclosed embodiments, the desired high strength was able to be secured, but SSC resistance deteriorated. In addition, in Steel Pipe No. 27 in which the components were within the ranges of the disclosed embodiments but the numbers of inclusions were outside of the ranges of the disclosed embodiments, SSC resistance deteriorated.

The invention claimed is:

1. A high-strength seamless steel pipe for oil country tubular goods having a yield strength (YS) of 866 MPa or higher, the steel pipe having a chemical composition comprising, by mass %:

C: 0.20% to 0.50%;
Si: 0.05% to 0.40%;
Mn: 0.3% to 0.9%;
P: 0.015% or less;
S: 0.005% or less;
Al: 0.005% to 0.1%;
N: 0.006% or less;
Cr: more than 0.6% and 1.7% or less;
Mo: more than 1.0% and 3.0% or less;
V: 0.02% to 0.3%;
Nb: 0.001% or more and less than 0.01%;
B: 0.0003% to 0.0030%;
O: 0.0030% or less;
Ti: 0.003% to 0.025%; and
a remainder including Fe and unavoidable impurities,
wherein a ratio of Ti to N is in a range of 2.0 to 5.0,
the steel pipe has a microstructure including (i) tempered martensite having a volume ratio of 95% or more, and (ii) prior austenite grains having a grain size number of 8.5 or more, and
in a cross-section perpendicular to a rolling direction of the steel pipe (i) a number of nitride-based inclusions having a particle size of 4 μm or more is 100 or less per 100 $mm^2$, (ii) a number of nitride-based inclusions having a particle size of less than 4 μm is 1000 or less per 100 $mm^2$, (iii) a number of oxide-based inclusions having a particle size of 4 μm or more is 40 or less per 100 $mm^2$, and (iv) a number of oxide-based inclusions having a particle size of less than 4 μm is 400 or less per 100 $mm^2$.

2. The high-strength seamless steel pipe for oil country tubular goods according to claim 1, wherein the chemical composition further comprises at least one selected from the group consisting of, by mass %, Cu: 1.0% or less, Ni: 1.0% or less, and W: 3.0% or less.

3. The high-strength seamless steel pipe for oil country tubular goods according to claim 1, wherein the chemical composition further comprises, by mass %, Ca: 0.0005% to 0.005%.

4. The high-strength seamless steel pipe for oil country tubular goods according to claim 2, wherein the chemical composition further comprises, by mass %, Ca: 0.0005% to 0.005%.

5. The high-strength seamless steel pipe for oil country tubular goods according to claim 1, wherein the chemical composition comprises Mo: more than 1.1% and 3.0% or less.

6. The high-strength seamless steel pipe for oil country tubular goods according to claim 2, wherein the chemical composition comprises Mo: more than 1.1% and 3.0% or less.

7. The high-strength seamless steel pipe for oil country tubular goods according to claim 3, wherein the chemical composition comprises Mo: more than 1.1% and 3.0% or less.

8. The high-strength seamless steel pipe for oil country tubular goods according to claim 4, wherein the chemical composition comprises Mo: more than 1.1% and 3.0% or less.

9. The high-strength seamless steel pipe for oil country tubular goods according to claim 1, wherein the chemical composition comprises Nb: 0.001% or more and 0.009% or less.

10. The high-strength seamless steel pipe for oil country tubular goods according to claim 2, wherein the chemical composition comprises Nb: 0.001% or more and 0.009% or less.

11. The high-strength seamless steel pipe for oil country tubular goods according to claim 3, wherein the chemical composition comprises Nb: 0.001% or more and 0.009% or less.

12. The high-strength seamless steel pipe for oil country tubular goods according to claim 4, wherein the chemical composition comprises Nb: 0.001% or more and 0.009% or less.

13. A method of producing the high-strength seamless steel pipe according to claim 1, the method comprising:

performing heating on a steel pipe raw material at a heating temperature in a range of 1050° C. to 1350° C.;
performing hot working on the heated steel pipe raw material to form a seamless steel pipe having a predetermined shape;
performing cooling on the seamless steel pipe at a cooling rate equal to or higher than that of air cooling after the hot working until a surface temperature of the seamless steel pipe reaches 200° C. or lower;
performing a quenching treatment on the seamless steel pipe at least once after the cooling in which the seamless steel pipe is (i) reheated to a temperature in a range of an $Ac_3$ transformation point to 1000° C. or lower, and (ii) rapidly cooled until the surface temperature of the seamless steel pipe reaches 200° C. or lower; and
performing a tempering treatment after the quenching treatment in which the seamless steel pipe is heated to a temperature in a range of 600° C. to 740° C.

14. A method of producing the high-strength seamless steel pipe according to claim 2, the method comprising:

performing heating on a steel pipe raw material at a heating temperature in a range of 1050° C. to 1350° C.;
performing hot working on the heated steel pipe raw material to form a seamless steel pipe having a predetermined shape;
performing cooling on the seamless steel pipe at a cooling rate equal to or higher than that of air cooling after the hot working until a surface temperature of the seamless steel pipe reaches 200° C. or lower;
performing a quenching treatment on the seamless steel pipe at least once after the cooling in which the seamless steel pipe is (i) reheated to a temperature in a range of an $Ac_3$ transformation point to 1000° C. or lower, and (ii) rapidly cooled until the surface temperature of the seamless steel pipe reaches 200° C. or lower; and
performing a tempering treatment after the quenching treatment in which the seamless steel pipe is heated to a temperature in a range of 600° C. to 740° C.

15. A method of producing the high-strength seamless steel pipe according to claim 3, the method comprising:

performing heating on a steel pipe raw material at a heating temperature in a range of 1050° C. to 1350° C.;
performing hot working on the heated steel pipe raw material to form a seamless steel pipe having a predetermined shape;
performing cooling on the seamless steel pipe at a cooling rate equal to or higher than that of air cooling after the hot working until a surface temperature of the seamless steel pipe reaches 200° C. or lower;

performing a quenching treatment on the seamless steel pipe at least once after the cooling in which the seamless steel pipe is (i) reheated to a temperature in a range of an $Ac_3$ transformation point to 1000° C. or lower, and (ii) rapidly cooled until the surface temperature of the seamless steel pipe reaches 200° C. or lower; and performing a tempering treatment after the quenching treatment in which the seamless steel pipe is heated to a temperature in a range of 600° C. to 740° C.

16. A method of producing the high-strength seamless steel pipe according to claim 4, the method comprising:

performing heating on a steel pipe raw material at a heating temperature in a range of 1050° C. to 1350° C.;

performing hot working on the heated steel pipe raw material to form a seamless steel pipe having a predetermined shape;

performing cooling on the seamless steel pipe at a cooling rate equal to or higher than that of air cooling after the hot working until a surface temperature of the seamless steel pipe reaches 200° C. or lower;

performing a quenching treatment on the seamless steel pipe at least once after the cooling in which the seamless steel pipe is (i) reheated to a temperature in a range of an $Ac_3$ transformation point to 1000° C. or lower, and (ii) rapidly cooled until the surface temperature of the seamless steel pipe reaches 200° C. or lower; and performing a tempering treatment after the quenching treatment in which the seamless steel pipe is heated to a temperature in a range of 600° C. to 740° C.

* * * * *